United States Patent [19]

Hemmann et al.

[11] Patent Number: 4,766,275

[45] Date of Patent: Aug. 23, 1988

[54] DOLL OR THE LIKE WITH MOTION SENSING SWITCH AND SWITCH THEREFOR

[75] Inventors: Ronald S. Hemmann, Newington; Frank Mercurio, Wallingford, both of Conn.

[73] Assignee: Coleco Industries, Inc., West Hartford, Conn.

[21] Appl. No.: 11,832

[22] Filed: Feb. 6, 1987

[51] Int. Cl.[4] ..... H01H 1/16; H01H 35/02

[52] U.S. Cl. ..... 200/153 A; 200/61.52; 200/277

[58] Field of Search ..... 200/153 A, 277, 61.52, 200/188, 236

[56] References Cited

U.S. PATENT DOCUMENTS

| | | | |
|---|---|---|---|
| 3,217,120 | 11/1965 | Bowen et al. | 200/61.52 |
| 3,263,033 | 7/1966 | Metzger | 200/8 R |
| 3,311,717 | 3/1967 | Lace | 200/8 R |
| 3,520,200 | 7/1970 | Rodgers | 73/577 R |
| 3,533,399 | 1/1971 | Osen et al. | 200/61.45 R |
| 3,619,524 | 11/1971 | Gillund | 200/61.45 M |
| 3,752,945 | 8/1973 | Achterberg | 200/277 |
| 4,001,185 | 1/1977 | Mitsui et al. | 200/277 |
| 4,022,998 | 5/1977 | Fohl | 200/61.45 R |
| 4,042,796 | 8/1977 | Zink | 200/61.52 |
| 4,450,326 | 5/1984 | Ledger | 200/61.45 M |
| 4,503,299 | 3/1985 | Henrard et al. | 200/61.52 |

FOREIGN PATENT DOCUMENTS

| | | | |
|---|---|---|---|
| 905464 | 7/1972 | Canada | 200/61.52 |
| 2709397 | 4/1978 | Fed. Rep. of Germany . | |

*Primary Examiner*—Renee S. Luebke

[57] ABSTRACT

A motion sensing device wherein a conductive ball is movable with a cavity defined by a base member defining a cylindrical cavity and a closure member to make and break electrical contact between top and bottom contact members of a first potential and sidewall contacts of another potential.

9 Claims, 1 Drawing Sheet

DOLL OR THE LIKE WITH MOTION SENSING SWITCH AND SWITCH THEREFOR

CROSS-REFERENCE TO RELATED APPLICATION

Copending application Ser. No. 11,836 filed Feb. 6, 1987 and assigned to the same assignee as this application discloses a device that senses both motion and position.

FIELD OF THE INVENTION

This invention relates to devices that sense motion and provide an electrical signal in response thereto.

BACKGROUND OF THE INVENTION

Motion sensing switches are quite well known and in one form thereof comprise a housing having a plurality of contacts therein and a movable member, generally in the form of a ball which may move in the housing and make and break electrical contact with contacts and thus signal that motion of the ball has occurred. The frequency of the making and breaking the electrical contacts will provide an indication of the severity or degree of motion. Examples of such motion sensing switches are shown in U.S. Pat. Nos. 3,553,399; 3,752,945; 3,520,200; 3,619,524; and German Patent No. 2,709,397.

These prior art designs are not generally of a construction which is inexpensive to manufacture, and some will not indicate make and break of contacts in all positional orientations of the device.

In various toys such as dolls and toys, more particularly, dolls and toys with synthesized speech, it is desired to have more interaction between the child and the doll. Heretofore, depending upon the planned behavior of the doll or toy, it is important for the logic system of the doll or toy to be able to sense motion and also the severity of the motion. For example, if the doll is gently rocked, the degree of motion may be sensed and an appropriate speech phrase generated. However, if the doll is violently shook, the logic system of the doll may cause the doll to enter another mode of speech operation, asking that it not be abused. Still further, the logic system of the doll may be programmed to ask the child to bounce the doll on the child's knee, or perform some other operation; in which case, sensing of motion is necessary.

In the manufacture of toys, cost is a prime consideration in order that the toy may be marketed at a reasonable price. Accordingly, the present invention provides a new and improved motion sensing device of simplified construction which is reliable in operation over the life of the toy and which will provide signals indicative of motion, regardless of the positional orientation of the device.

SUMMARY OF THE INVENTION

Briefly stated, the invention in one form thereof comprises a base member adapted to be fastened to a printed circuit board. The base member has an upstanding cylindrical sidewall defining a cavity which receives a conductive ball. The base member is also relieved at its top edge and in the sidewalls to receive contacts which extend through the base member and the circuit board. The sidewall contacts are of inverted J shape and are equiangularly spaced about the interior sidewall of the base member in the relieved portions with the J portions overlying the outer surface. An inverted U shape contact member is positioned over the cylindrical sidewall portion of the base member and has legs extending therethrough with the bight portion essentially diametrically overlying the cylindrical portion.

All contacts are securely fastened to the base member by a closure member fitting thereover. The closure member has opposed openings in the sidewalls which receive detents along the outside of the cylindrical wall of the base member. Thus, the contacts are at the upper edges locked to the base member by the cap and intermediate the ends thereof are held in openings defined in the base member. A contact member having a partially aspherical head extends through an opening in the base member and the conductive ball will normally rest on this contact member in contact with either one of the J contacts or the inside sidewall of the cylindrical portion.

An object of this invention is to provide a new and improved motion sensing device which is simplified in construction.

Another object of this invention is to provide a new and improved motion sensing device which will make and break contacts upon motion regardless of the positional attitude of the motion sensing device.

The features of the invention which are believed to be novel are particularly pointed out and distinctly claimed in the concluding portion of the specification. The invention, however, together with further objects and advantages thereof, may best be appreciated by reference to the following detailed description taken in conjunction with the drawings.

DETAILED DESCRIPTION OF THE ILLUSTRATED EMBODIMENT

Figure 1:
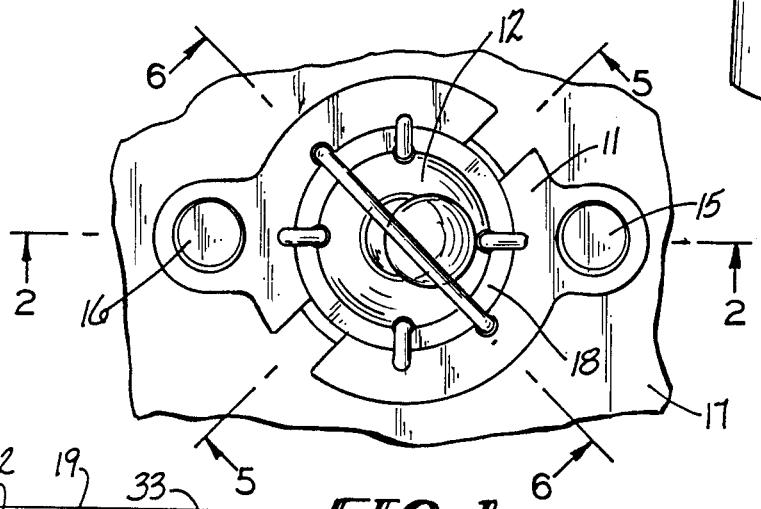
FIG. 1 is a plan view of a motion sensor embodying the invention with the top removed.
Figure 2:
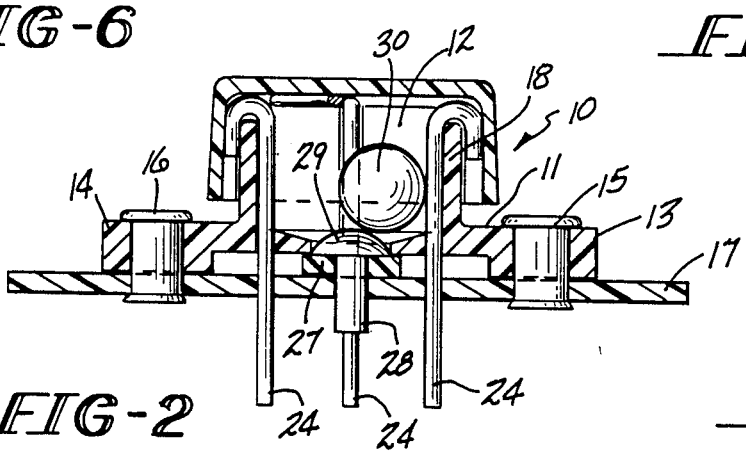
FIG. 2 is a sectional view seen in the plane of lines 2—2 of FIG. 1, with the top installed.

A motion sensing device which embodies the invention is shown in plan view in FIG. 1 with the top closure removed, while FIG. 2 shows a sectional elevation of the device of FIG. 1 with the closure member thereon. A motion sensing device embodying the invention will be initially described considering FIGS. 1 and 2.

The motion sensing device 10 comprises a base member 11 defining a cylindrical cavity 12 and having ears 13 and 14 with apertures therethrough arranged to accept fastening rivets 15 and 16 so that the base member 11 may be secured to a printed circuit board 17. The circuit board 17 will have apertures therethrough adapted to receive electrical leads from the device 10.

Figure 7:
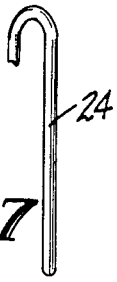
FIG. 7 is a view of a contact pin utilized in the invention.
Figure 3:
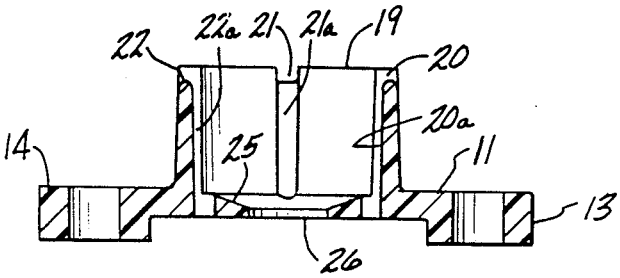
FIG. 3 is a view similar to FIG. 2, but with the top off and the contact pins removed.
Figure 8:
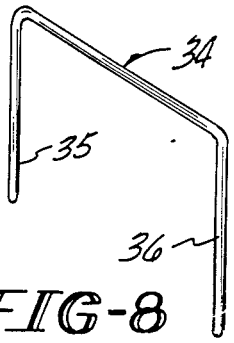
FIG. 8 is a perspective view of another contact pin utilized in the invention.

The cavity 12 is defined by an upstanding wall 18 and the upper edge 19 thereof is formed with four indentations 20, 21 and 22, (only three shown in FIG. 3) which are displaced ninety degrees apart. These upper edge indentations are co-extensive with relieved portions 20*a*, 21*a* and 22*a* in the interior sidewall of upright wall 18. Four J-shaped contacts 24, as shown in FIG. 7, are received in the indentations and mating relieved portions, as shown in FIG. 2.

Member 11 has a slight frustoconical bottom surface 25 with an opening 26 therein. Positioned on board 17 is a spacer member 27 carrying a contact member 28 with a partially spherical head 29 which extends above a portion of the frustoconical surface 25.

A conductive ball, or a ball with a conductive coating thereon, 30, is received within cavity 12 and is so dimensioned that it will rest in a passive position on the partially spherical head 29 and generally in contact with one of the J contact pins 24.

Figure 6:
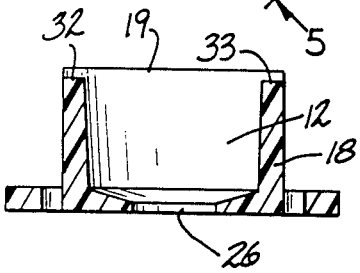
FIG. 6 is a view seen in the plane of lines 6—6 of FIG. 1 with the contacts removed.

As shown in FIG. 6, the upper edge 19 is relieved at two more diametrically opposite points 32 and 33 which receive therein an inverted U contact pin 34 having legs 35 and 36 which extend through circuit board 17. The bight portion of this U contact 34 is received in the indentations 32 and 33, and the leqs 35 and 36 will extend through circuit board 17.

Figure 5:
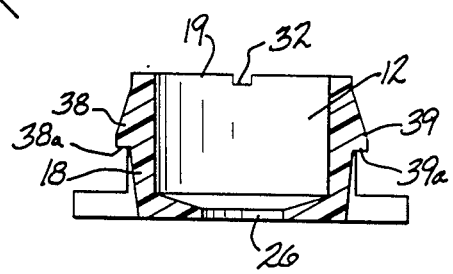
FIG. 5 is a view seen in the plane of lines 5—5 of FIG. 1 with the contacts removed.

As shown in FIG. 5, member 11 is formed with projecting detents 38 and 39 on opposed portions of the wall 18.

Figure 4:
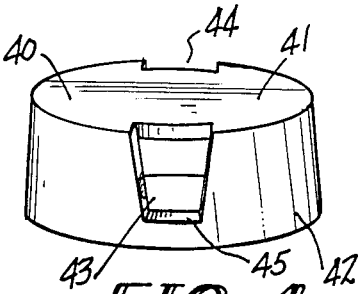
FIG. 4 is a perspective view of the top closure for the assembly of FIG. 1.

A top closure member 40 (FIG. 4) has a top portion 41, and a skirt portion 42. The skirt portion 42 has openings 43 and 44 on opposite sides thereof, which openings will receive the detents 38 and 39.

Both the base member 11 and the closure member 40 are molded of a plastic material which is electrically non-conductive. The cap portion is substantially rigid, but being of a plastic material, will permit some elastic deformation as it is slid over the inclined portions of the detents 38 and 39 before locking the detents in the openings 43 and 44.

In assembly, the J contacts 24 are positioned in the indentations in the top edge and the mating relieves in the inner wall. The conductive ball 30 is then placed within cavity 12. Contact 34 is then positioned in the indentations 32 and 33. Then the closure member 40 is positioned thereover so that the detents 38 and 39 are received in openings 43 and 44. The closure member then locks the contacts into the assembly.

At this point, the spacer 27 with contact 28 is placed on board 17 with the shank of contact 28 extending through board 17. Then the assembly, as shown in FIG. 2, is mounted to the board 17 with the contact pins 24 extending through apertures provided therefor, and also the apertures that are provided for the legs 35 and 36 of contact 34. Then the rivets 15 and 16 may be applied to mount the motion sensing device to the board.

In the alternative, the body member 11 with spacer 27 and contact 28 could be mounted to the board and then the contacts 24 and 34 mounted to body 11 and the closure member 40 applied.

It will be seen that the J portion of the contacts 24 are locked to body 11 by closure member 40, as is contact 34.

The closure member 40 will deform slightly to permit it to be passed over the inclined surfaces of detents 38 and 39. Thereafter, the bottom wall 45 of the openings 43 and 44 will lock beneath the bottom surfaces 38*a* and 39*a* of the detents.

In operation, conductive ball 30 will normally be sitting on one side of spherical head 29 and in contact with one of the J contacts 24. When a device upon which the switch is mounted is moved, the ball 30 will make and break contacts between ground and one of the power contacts. Normally, the J contacts are connected to B+ and the contacts 28 and 34 are connected to ground. The movement of ball 30 to make and break contacts will produce a change in sensed voltage levels which may be counted over predetermined units of time to determine the severity of the movement with respect to time.

The diameter of the ball is at least one half of the internal diameter of the cavity 12. Since both contacts 28 and 34 of the are at the same potential, the device is sensitive to motion either in the shown position or a position inverted one hundred eighty degrees with respect thereto.

The height of the cavity 12 with closure 40 thereon is less than twice the diameter of ball 30. Therefore, ball 30 will be in contact with a B+ contact and a ground contact essentially at all times regardless of positional orientation and adapted to make and break contacts upon any motion of the device.

Accordingly, it may thus be seen that the objects of the invention set forth, as well as those made apparent from the foregoing description, are efficiently attained. While a preferred embodiment of the invention has been set forth for purposes of disclosure, modifications to the disclosed embodiment of the invention, as well as other embodiments thereof, may occur to those skilled in the art. Accordingly, the appended claims are intended to cover all embodiments of the invention and modifications to the disclosed embodiments which do not depart from the spirit and scope of the invention.

Having thus described the invention, what is claimed is:

1. A motion sensing device in which a conductive ball makes and breaks electrical contact with one of a plurality of stationary contacts, comprising a conductive ball; a base member having a bottom wall providing a recess of inverted frustoconical configuration therein and an opening therethrough in said recess, said base member also having an upstanding cylindrical wall about said recess with inside and outside surfaces and defining a cavity open at an upper end of said sidewall; a plurality of equiangularly spaced contacts having an inverted J-shaped end extending over the upper end of said sidewall and extending vertically through said base member; and inverted U-shaped contact member having legs and a bight portion disposed on said sidewall with said legs extending through said base member, said bight portion extending across said open end of said cavity, said sidewall having opposed detents on the outside surface thereof; a closure member having opposed openings therein fitted over said cylindrical wall with said detents received in said openings to lock said closure member to said base member; and a contact member having a partially cylindrical head extending into said cavity, said ball being disposed within said cavity and normally contacting the bight portion of said U-shaped contact or said partially cylindrical head and one of said J-shaped contacts.

2. The device of claim 1, where said base member and said closure member are of electrically insulating material and said closure member is sufficiently deformable to permit said closure member to ride over said detents until said detents are received in said openings in said closure member.

3. The device of claim 1, where said sidewall is relieved on said inside surface thereof and at said upper end thereof to receive said equiangularly spaced J-shaped contacts.

4. The device of claim 1, where said sidewall has an inside diameter and said ball has a diameter at least one-half as great as the inside diameter of said cylindrical sidewall.

5. The device of claim 1, where said cavity with said closure on said base member has a height which is less than twice the diameter of said ball.

6. The device of claim 1, further including a mounting circuit board, said base member having ears with apertures for receiving fastening members.

7. The device of claim 6 further including a spacer member between the bottom wall and said circuit board, said spacer member positioning said contact member with the partially spherical head.

8. The device of claim 1, where said detents have inclined outside surfaces to facilitate passage of said closure member thereover.

9. The device of claim 8, where said detents have lower surfaces having flat portions which will lock into said openings in said cover member.

* * * * *